United States Patent [19]

Fukushima et al.

[11] 3,931,762

[45] Jan. 13, 1976

[54] METHOD FOR PREPARING A PLASTIC RELIEF PRINTING PLATE

[75] Inventors: Nobuo Fukushima; Masakazu Inoue, both of Ibaragi; Ryouzo Takai, Takatsuki; Kozo Hotta, Kokubunji, all of Japan

[73] Assignees: Sumitomo Chemical Company, Limited, Osaka; The Yomiuri Shimbun, Tokyo, both of Japan

[22] Filed: Dec. 14, 1973

[21] Appl. No.: 424,765

[30] Foreign Application Priority Data

Dec. 18, 1972 Japan ..... 47-127452

[52] U.S. Cl. ..... 101/401.1; 101/426; 156/78; 260/2.5 P; 260/2.5 H; 260/37 R; 260/41 R; 264/54; 264/220; 264/321; 264/53; 252/513

[51] Int. Cl.[2] ..... B41D 3/04

[58] Field of Search ..... 101/401.1, 404.1, 426; 264/51, 53, 54, 220, 321; 156/78; 260/2.5 P, 2.5 H, 37 R, 41 R

[56] References Cited

UNITED STATES PATENTS

| | | | |
|---|---|---|---|
| 3,031,959 | 5/1962 | Libberton | 101/401.1 |
| 3,221,654 | 12/1965 | Jernt | 101/401.1 |
| 3,408,437 | 10/1968 | Wheeler et al. | 264/220 |
| 3,463,687 | 8/1969 | Folsom et al. | 264/321 |
| 3,589,961 | 6/1971 | Fordyce etal. | 264/220 |

*Primary Examiner*—Edward G. Whitby

*Attorney, Agent, or Firm*—Stevens, Davis, Miller & Mosher

[57] ABSTRACT

When a thermoplastic resin sheet such as polyethylene, polypropylene, polystyrene, ABS or polyvinyl chloride resin sheet which contains 0 – 80 % by weight of an inorganic filler and has a foaming ratio (a) of 1 or $1 < a \leqq 4$ and which satisfies the relation $130 \geqq 20a + b \geqq 30$ (wherein "a" is the foaming ratio and "$b$" is amount of the inorganic filler) is pressed onto a matrix in such a manner that the thickness of said resin sheet before pressing is larger than the thickness of the convex portions of the resultant resin relief plate, thus obtained relief plate has excellent printability.

13 Claims, 2 Drawing Figures

METHOD FOR PREPARING A PLASTIC RELIEF PRINTING PLATE

The present invention relates to a method for producing a relief plate for printing.

Conventionally, in the field of newspaper printing, a relief plate for printing has been produced by the method which comprises putting a paper upon a composition or an etched metal relief plate, compressing them to obtain a paper matrix and casting lead into said matrix to obtain a lead printing plate (relief plate). However, lead is troublesomely handled because it injures human body and moreover it has a high specific gravity. As a substitution therefor, there has been developed a method which comprises putting a heated polycarbonate sheet upon a composition or an etched metal relief plate, compressing them to obtain a matrix and casting a molten polypropylene into the matrix to obtain a polypropylene plate. According to this method, different from the production of lead plate, human body is not injured and moreover the polypropylene has a low specific gravity. However, there is the defect that it requires a long production cycle. Furthermore, there has been a method which comprises putting a heated polypropylene sheet upon a paper matrix and compressing them to obtain a polypropylene plate, but since this method requires a heating furnace, it is necessary to broaden the operating area. In addition, fibers of paper which are peeled off stick to polypropylene plate to extremely damage the printing effect.

The inventors have made an extensive research in an attempt to overcome said defects to find that a synthetic resin sheet which does not undergo permanent deformation under a low load and undergoes permanent deformation only under a high load is put on a matrix and they are compressed in a solid state to obtain a printing relief plate having excellent printability.

Figure 1:
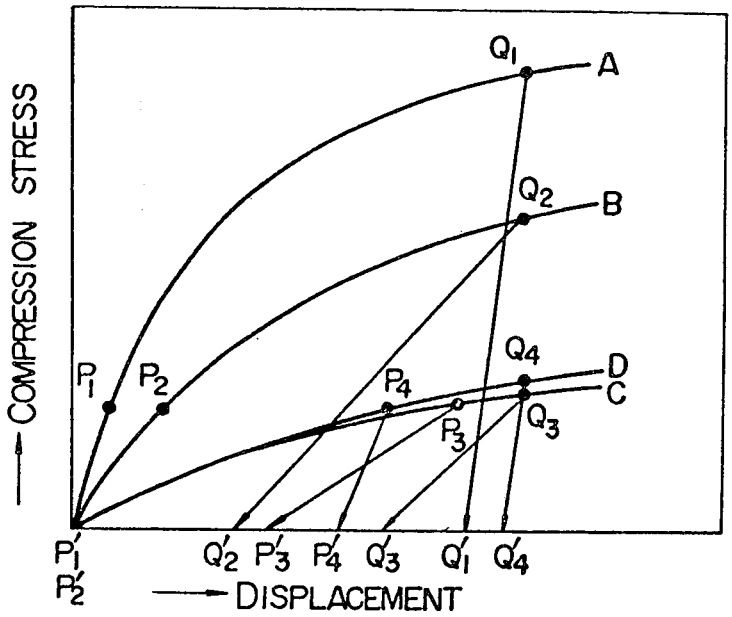
Figure 2:
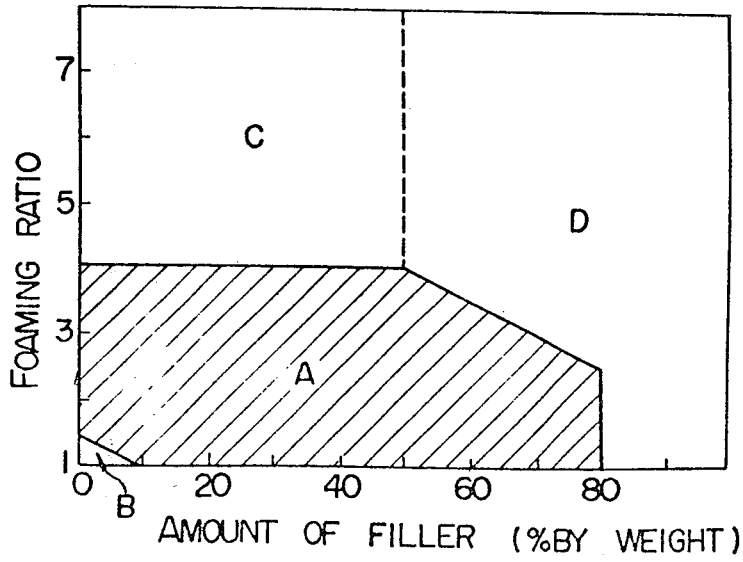

FIG. 1 shows compressional stress-displacement curves of various synthetic resin sheets and FIG. 2 shows a range of synthetic resin sheet used in the present invention.

In FIG. 1, point $P_1$ – point $P_4$ shows displacement under printing pressure, point $P'_1$ – point $P'_4$ shows displacement corresponding to point $P_1$ – point $P_4$ after removal of stress, point $Q_1$ – point $Q_4$ shows a stress required for displacement necessary for plate making and point $Q'_1$ – point $Q'_4$ shows displacement corresponding to point $Q_1$ – point $Q_4$ after removal of stress. The properties to be possessed by materials used as a relief plate for printing are that displacement under printing pressure is small and the displacement becomes 0 due to elastic recovery after removal of stress and that under a high stress at plate making step a high displacement is caused to result in buckling and after removal of stress the elastic recovery is slight or 0 as shown by point $Q_1$ – point $Q'_1$ in curve A in FIG. 1.

It has been found that a thermoplastic resin sheet which contains 0 – 80 % by weight of an inorganic filler and in which foaming ratio (a) is 1 (no-foaming) or $1 < a \leqq 4$ (foaming) and amount of the inorganic filler (b) (% by weight) and the foaming ratio (a) satisfy the formula $130 \geqq 20a + b \geqq 30$ is suitable as the material having the properties as mentioned above.

In the above formula, the foaming ratio (a) was calculated as follows:

Foaming ratio (a) = (Volume of sheet measured) × (Specific gravity of the sheet in unfoamed state)/(Apparent weight of the sheet measured)

The specific gravity in unfoamed state was theoretically determined from specific gravities of resin and filler and blending ratio thereof.

Suitable synthetic resins used in the present invention are thermoplastic resins, among which olefinic resins such as polyethylene, polypropylene and the like, styrene resins such as polystyrenes, ABS resin and the like, vinyl chloride resins which have a high stress at initial micro displacement are preferred.

The ranges of the amount of the filler and the foaming ratio employed in the present invention are shown in A in FIG. 2. In said formula, the upper limit 130 and the lower limit 30 were experimentally determined from applicability, as printing plate, of foamed sheets and unfoamed sheets of various resins containing the fillers. These were able to be used as printing plate within the area A in FIG. 2. However, because of brittleness of the printing plate, formula $100 \geqq 20a + b \geqq 30$ is preferred for practical rotary printing. Furthermore, in view of smoothness of surface, $1 \leqq a \leqq 3$ is desired for obtaining more beautiful printing effect. In case of range B where the foaming ratio and the amount of the filler are lower than those in the range A, the properties at printing step are nearly satisfied as shown by point $P_2 \rightarrow$ point $P'_2$, but the elastic recovery after removal of stress at plate making step is conspicuous as shown by point $Q_2 \rightarrow$ point $Q'_2$ in curve B in FIG. 1. Thus, when this sheet is pressed together with a matrix, a relief plate having convex portions of the desired height cannot be formed. On the other hand, in case of range C where the foaming ratio is higher than that of the present invention and the amount of the filler is relatively small, as shown by point $P_3 \rightarrow$ point $P'_3$ and point $Q_3 \rightarrow$ point $Q'_3$ in curve C in FIG. 1, plate making ability is relatively good, but relatively high displacement and permanant deformation are caused even under printing pressure and therefore ink is applied not only to convex portions, but also to the whole surface and all of thus applied ink is transferred to paper at printing to make it impossible to read the printed matter. Furthermore, in case of range D where the amount of the filler is larger than that of the present invention, as shown by point $P_4 \rightarrow$ point $P'_4$ and point $Q_4 \rightarrow$ point $Q'_4$ in curve D in FIG. 1, the plate making ability is good, but since it becomes impossible to read the printed matter as in the range C and moreover the sheet is extremely brittle, such sheet cannot be used for printing relief plate. On the other hand, in case of the range A specified in the present invention, as shown by point $P_1 \rightarrow$ point $P_1'$ and point $Q_1 \rightarrow$ point $Q'_1$ in curve A in FIG. 1, the sheet has a low foaming ratio and is not buckled under printing pressure because a suitable amount of the filler is contained therein and it is buckled and has small elastic recovery under plate making pressure. Therefore, the height of convex portions is sufficient and reproducibility of the shape of types is high. Thus, both plate making ability and printability are satisfactory.

Examples of the inorganic fillers used in the present invention are calcium carbonate, barium sulfate, aluminum hydroxide, titanium oxide, iron oxide, iron powders, nickel powders, γ-ferric oxide, etc. However, the present invention is not limited to use of only these fillers.

In the present invention, a sheet of thermo-plastic resin which is not foamed or is foamed at the ratio of 4 times or less is used. The foaming of the sheet may be attained by blending a blowing agent of thermal decomposition type, by impregnating the sheet with a volatile solvent, or by pumping a volatile solvent or a gas into the kneading portion of an extruder. Examples of said thermally decomposiing blowing agent are azobisisobutyronitrile, azodicarbonamide, oxybisbenzenesulfonylhydrazine, etc., those of the volatile solvent are n-hexane, n-pentane, 1,2-dichlorofluoroethane, etc. and those of the gas are nitrogen, etc.

According to the present invention, suitable matrix plate and said synthetic resin sheet are allowed to lie one upon another and they are pressed and a plate type pressing machine and a roll pressing machine are suitable as the pressing machine. Furthermore, it is also possible that only the surface layer of said synthetic resin sheet is heated immediately before pressing, then this sheet is allowed to lie on a matrix and they are pressed.

As the matrix plate used in the present invention, resin matrix produced, for example, by pressing polycarbonate, nylon, polysulfone, ABS resin, polypropylene, etc. onto a type matter or an etched metal relief plate at a high temperature, no-backing paper matrix, concave type matter, etched metal intaglio plate, paper matrix hardenable with resin, etc. may be used, but these must be optionally chosen depending upon the kind of the synthetic resin sheet used in the present invention. In short, such matrix as standing the pressing pressure at plate making may be chosen.

In the present invention, it is necessary to carry out the compression so that the relation—thickness of the synthetic resin sheet before pressing > thickness of projections of the convex portion of synthetic resin relief plate — is attained.

That is, in case of the thickness of synthetic resin sheet before pressing being equal to the thickness of the projections of the convex portion of synthetic resin relief plate, the synthetic resin sheet is not sufficiently pressed into the matrix and the height of projections of the convex portion of the relief plate obtained is low. Thus, good printing cannot be accomplished. On the other hand, within the limited range of the present invention, not only the convex portions of the relief plate, but also the concave portions undergo compressive power and are buckled and deformed, whereby the convex portions which can sufficiently stand the printing pressure are formed and thus a relief plate having a high printing resistance can be produced.

When a foamed sheet is used in the present invention, preferably at least the surface of the plate to be convexed should be non-foamed layer to improve transferability of ink plate and oil resistance. Resin to be used as the non-foamed layer is preferably the same as the resin of the foamed layer, but in case of using bonding agent between the two layers, other thermoplastic resins may be used. For forming the non-foamed layer, the following methods may be employed: immediately after extrusion of foamable sheet, the surface of the sheet is cooled and solidified to prevent the foaming (to form a non-foamed layer); only the surface of a foamed sheet is softened and then compressed to crush the foamed layer; foamed layer and non-foamed layer are simultaneously extruded; non-foamed resin is extrusion coated on a foamed sheet; a non-foamed film is dry-laminated on a foamed sheet; and foamed sheet and un-foamed film are bonded by supplying a molten resin capable of bonding the two. Furthermore, fillers may be added to the non-foamed layer. Moreover, a synthetic resin solution can be applied or sprayed onto a relief plate of foamed sheet to coat the surface of the relief plate with a smooth resin to further improve printability.

In the present invention, said magnetizing fillers may be incorporated into the synthetic resin sheet to make it possible to easily load the synthetic resin sheet in a printing machine loaded with a magnetizing saddle. When the magnetizing fillers are not contained, a laminate of the synthetic resin sheet with a iron plate or nickel plate as a magnetizing back sheet or with a synthetic resin sheet containing iron powders, nickel powders or $\gamma$-ferric oxide may be used.

The present invention is illustrated more specifically in the following examples which, however, are not to be construed as imposing any particular limitation thereon.

EXAMPLE 1

An ABS resin foamed sheet having a foaming ratio of 1.8 times and a thickness of 1 mm was put upon a polycarbonate resin matrix having a maximum dent depth of 0.6 mm and a thickness of 2 mm. These were pressed by a plate type press until the distance between the plates became 2.3 mm at room temperature and they were allowed to stand for 5 seconds. The height of convex portions of thus obtained ABS resin relief plate was 0.55 mm and thickness of the convex portions was 0.98 mm. Rotary press printing was carried out using thus obtained relief plate to obtain a printed matter having an excellent resolving power and printing resistance.

REFERENTIAL EXAMPLE 1

Example 1 was repeated except that an ABS resin foamed sheet having a foaming ratio of 8 times and a thickness of 1 mm was used. The height of the convex portions of thus obtained ABS resin relief plate was 0.6 mm and thickness of the convex portions was 1 mm. When rotary press printing was carried out using said relief plate, ink was transferred onto the whole surface of the plate and the printed matter could not utterly be read because the convex portions were displaced under a low stress. Furthermore, after one printing, the relief plate was changed to nearly plane plate and the printing resistance was also low.

REFERENTIAL EXAMPLE 2

Example 1 was repeated except that a non-foamed ABS resin sheet having a thickness of 1 mm was used. At this time, the distance between the plates was 2.7 mm. Height of convex portions of thus obtained ABS resin relief plate was 0.17 mm and thickness of the convex portions was 1 mm. When rotary press printing was carried out using said plate, since the height of the convex portions was low, ink was also transferred to the portions other than the convex portions and printability was not good.

EXAMPLE 2

Example 1 was repeated except that a low density polyethylene resin sheet containing 50 % by weight of calcium carbonate and having a thickness of 1 mm was used. Height of convex portions of thus obtained polyethylene relief plate was 0.4 mm and thickness of the convex portions was 0.99 mm. This relief plate had the same printability as that of Example 1.

REFERENTIAL EXAMPLE 3

Example 1 was repeated except that a low density polyethylene resin sheet containing 90 % by weight of calcium carbonate and having a thickness of 1 mm was used. Height of convex portions of thus obtained polyethylene relief plate was 0.53 mm and thickness of the convex portions was 0.94 mm. The convex portions of this relief plate were very brittle and printing resistance was extremely low.

EXAMPLE 3

A mixture of 100 parts of polypropylene resin, 2 parts of azodicarbonamide (corresponding to a foaming ratio of 2 times) and 50 parts of barium sulfate was extruded from a slit die into a sheet of 1 mm in thickness to obtain a foamed sheet containing filler. This sheet was pressed in the same manner as in Example 1. Height of convex portions of thus obtained polypropylene relief plate was 0.58 and thickness of the convex portions was 0.92 mm. This relief plate had more excellent printability than that of the plate obtained in Example 1.

EXAMPLE 4

A polystyrene containing 1.5 % by weight of n-pentane and heated to 170°C and a mixture of 100 parts of polystyrene and 40 parts of calcium carbonate heated to 190°C were simultaneously extruded from a slit die at 170°C to produce a two-layer sheet comprising a layer containing the filler having a thickness of 0.1 mm and a foamed layer (foaming ratio 2 times) having a thickness of 0.9 mm. The layer containing the filler was allowed to be in contact with the resin matrix and the sheet and the matrix were pressed in the same manner as in Example 1. Height of convex portions of thus obtained polystyrene relief plate was 0.55 mm and thickness of the convex portions was 0.97 mm. This relief plate was excellent in ink transferability because the convex portions were smooth and had a printability superior to that of the plate obtained in Example 1.

EXAMPLE 5

A sheet of laminate comprising the synthetic resin sheet used in Example 3 and a polypropylene film containing 10 % by weight of $\gamma$-ferric oxide and having a thickness of 50 $\mu$ was pressed in the same manner as in Example 1. Thus obtained polypropylene relief plate could easily be loaded in a printing machine having a magnetic saddle and moreover had an excellent printability.

EXAMPLE 6

One face of HIPS resin foamed sheet of 2 mm in thickness having a foaming ratio of 1.5 time and containing 40 % by weight of titanium oxide was heated with an infrared heater to soften only the surface layer. Immediately thereafter said heated face was pressed onto polycarbonate resin matrix by a rolling machine. Height of convex portions of thus obtained relief plate was 0.58 mm and thickness of the convex portions was 1.98 mm. Printability of this relief plate was nearly the same as that of Example 1.

EXAMPLE 7

Only the surface of a low density polyethylene sheet containing 60 % by weight of aluminum hydroxide and having a foaming ratio of 3 times was softened and the sheet was passed through a heating rolls to obtain a sheet of 1.5 mm in thickness having a smooth surface. This sheet was pressed until the distance between the plates became 2.8 mm in the same manner as in Example 1. Height of convex portions of thus obtained polyethylene relief plate was 0.45 mm and thickness of convex portion was 1.3 mm. Printability of this relief plate was good.

REFERENTIAL EXAMPLE 4

A low density polyethylene sheet containing 70 % by weight of aluminum hydroxide and having a foaming ratio of 4 times and a thickness of 1.5 mm was pressed in the same manner as in Example 7. Height of convex portions of thus obtained relief plate was 0.50 mm and thickness of the convex portions was 1.3 mm. Rotary printing was carried out using this relief plate. Printing effect was rough and was further decreased with increase in printing numbers.

What is claimed is:

1. In a method for producing synthetic resin relief plate by pressing a synthetic resin sheet onto a matrix, the improvement which comprises putting on the matrix a thermoplastic synthetic resin sheet which contains 0 – 80% by weight of inorganic filler and has a foaming ratio of 1 or $1 < a \leqq 4$ and in which the amount of the inorganic filler (% by weight) and the foaming ratio satisfy the formula $130 \geqq 20a + b \geqq 30$ wherein $a$ represents a foaming ratio and $b$ represents the amount of the inorganic filler and then pressing the sheet in solid state and the matrix so that the thickness of the synthetic resin sheet before being pressed is larger than the thickness of the convex portions of the synthetic resin relief plate.

2. A method according to claim 1, wherein after only surface layer of the synthetic resin sheet which contacts with the matrix is softened, the sheet is put on the matrix and these are pressed.

3. A method according to claim 1, wherein at least one side of the synthetic resin foamed sheet is non-foamed layer.

4. A method according to claim 3, wherein a resin containing a foaming agent and a resin containing no foaming agent are simultaneously extruded from one die slit to obtain a synthetic resin sheet at least one side of which is non-foamed layer.

5. A method according to claim 3, wherein the foamed sheet and the non-foamed film are bonded by supplying a molten resin capable of bonding these sheets therebetween.

6. A method according to claim 1, wherein a synthetic thermoplastic resin selected from the group consisting of polyethylene, polypropylene, polystyrene, ABS and polyvinyl chloride is used.

7. A method according to claim 1, wherein the said inorganic filler is selected from the group consisting of calcium carbonate, barium sulfate, aluminum hydroxide, clay, titanium oxide, iron oxide, iron powders, nickel powders or $\gamma$-ferric oxide.

8. A method according to claim 1, wherein a blowing agent selected from the group consisting of azobisisobutyronitrile, azodicarbonamide or oxybisbenzenesulfonyl hydrazine.

9. A method according to claim 1, wherein a volatile solvent selected from the group consisting of n-hexane, n-pentane or 1,2-dichlorofluoroethane is used as a blowing agent.

10. A method according to claim 1, wherein the thermoplastic synthetic resin is put on the matrix and these are pressed by a plate pressing machine.

11. A method according to claim 1, wherein the thermoplastic synthetic resin is put on the matrix and these are pressed by a roll pressing machine.

12. A method according to claim 1 claims, wherein a laminate of magnetizing sheets is used as the synthetic resin sheet.

13. A printing relief plate produced by the method according to claim 1.

* * * * *